US006556794B2

(12) United States Patent
Miura

(10) Patent No.: US 6,556,794 B2
(45) Date of Patent: Apr. 29, 2003

(54) CARRYING APPARATUS AND IMAGE FORMING APPARATUS

(75) Inventor: Tatsuyuki Miura, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,608

(22) Filed: Aug. 23, 2001

(65) Prior Publication Data

US 2003/0039477 A1 Feb. 27, 2003

(51) Int. Cl.[7] ..... G03G 15/00
(52) U.S. Cl. ..... 399/18; 79/33
(58) Field of Search ..... 399/33, 16, 19, 399/21, 322, 18, 79; 219/216

(56) References Cited

U.S. PATENT DOCUMENTS 3,791,732 A * 2/1974 Mihalik et al. ..... 219/216
4,118,178 A * 10/1978 Calvi et al. ..... 219/216
4,402,594 A * 9/1983 Pelda et al. ..... 219/216
5,300,981 A * 4/1994 Shioya ..... 399/33
5,532,793 A 7/1996 Koruge

FOREIGN PATENT DOCUMENTS

JP 54021740 A * 2/1979 ..... G03G/15/20
JP 04084160 A * 3/1992 ..... G03G/15/00
JP 7-120984 5/1995
JP 2001005345 A * 1/2001 ..... G03G/21/00

* cited by examiner

*Primary Examiner*—Robert Beatty
(74) *Attorney, Agent, or Firm*—Foley & Lardner

(57) ABSTRACT

The carrying apparatus comprises a carrying device for carrying an object to be carried, along a carrying route, a heating device for heating the object being carried along the carrying route, a control device for temporarily stopping and keeping the object being carried along the carrying route, and a detection device for detecting whether the object is positioned at the heating device, when carrying of the object is temporarily stopped by the control device, wherein if the detection device detects the object positioned at the heating device, the control device controls operation of the carrying device so as to carry the object until the detection device does not detect the object any more, and then to stop carrying of the object.

12 Claims, 6 Drawing Sheets

CARRYING APPARATUS AND IMAGE FORMING APPARATUS

BACKGROUND OF THE INVENTION

The present invention relates to a carrying apparatus and an image forming apparatus which are contained in, for example, an electrophotographic copying machine carrying paper sheets.

In some electrophotographic copying machines, images can be formed on both surfaces of a paper sheet. When images are formed on both surfaces of a paper sheet in these electrophotographic copying machines, paper sheets are fed from a sheet feed cassette through a sheet carrying route to an image forming section (hereinafter called simply an ADU). An image is formed on one surface of the paper sheet, and the image is then heated by a fixing device, to fix it to the paper sheet. The paper sheet having the image fixed to its surface is once stacked and contained into an intermediate tray. Subsequently, the paper sheet thus stacked and contained in the intermediate tray is fed again to the image forming section, and an image is transferred to its back surface. In this manner, images are formed on both surfaces of the paper sheet which is then discharged onto a sheet discharge tray.

Meanwhile, paper sheets stacked on the intermediate tray are applied with static electricity. Therefore, fed paper sheets easily tend to be stuck to each other when the paper sheets are fed again from the intermediate tray.

In addition, since a paper sheet having a surface on which an image has been formed must once be stacked and contained in the intermediate tray, image formation cannot be performed sequentially on its back surface. Time loss is hence caused so that the image forming efficiency is lowered.

To solve the above-described problems of fed paper sheets being stuck to each other and the image forming efficiency being lowered, development has been made in an electrophotographic copying machine which adopts a so-called non-stack ADU.

That is, in this electrophotographic copying machine, the intermediate tray is excluded from the ADU. Images are formed sequentially on the surfaces of a plurality of paper sheets. Further, these paper sheets are sequentially reversed by a reverse carrying means, and are directly sent to the image forming section. Images are formed on the back surfaces of the paper sheets.

In some cases, the non-stack ADU is used with an accounting device such as a coin controller attached to the ADU. If a total of 4 pages are double-side-printed on two paper sheets in an electrophotographic copying machine attached with the accounting device, for example, there may be a case that the inserted money runs short at the time point when printing on pages 1, 2, and 4 pages is finished.

In this case, the paper sheet on which the third page should be printed is discharged without carrying out printing, or is kept on the ADU in the apparatus.

It is, however, unkind to users to discharge the paper sheets without completing the printing process.

On the other hand, if a paper sheet is kept on the ADU, it may be stopped at the fixing device. If it is positioned at the fixing device, the paper sheet may be burnt, emit smoke, or catch fire due to the fixing device.

If the heat source of the fixing device is turned off when a paper sheet is kept, the paper sheet does not burn, smoke, or catch fire. However, in order to turn off the fixing device to pause carrying of the paper sheet during printing operation, the fixing device must be heated again at the time of restarting the printing operation. The processing efficiency is undesirably deteriorated.

BRIEF SUMMARY OF THE INVENTION

The present invention has been made in view of the situation described above and has an object of providing a carrying apparatus and an image forming apparatus in which an object to be carried (to which an image should be transferred) is not positioned at the fixing device when the object is temporarily kept.

A carrying apparatus according to the present invention comprises: a carrying device for carrying an object to be carried, along a carrying route; a heating device for heating the object being carried along the carrying route; a control device for temporarily stopping and keeping the object being carried along the carrying route, if necessary; and a detection device for detecting whether the object is positioned at the heating device, when carrying of the object is temporarily stopped by the control device, wherein if the detection device detects the object positioned at the heating device, the control device controls operation of the carrying device so as to carry the object until the detection device does not detect the object any more, and then to stop carrying of the object.

An image forming apparatus according to the present invention comprises: an image forming device for forming an image on an image carrier; a transfer device for transferring the image formed by the image forming device, to one surface of an object to which an image should be transferred; a fixing device for heating the image transferred by the transfer device, thereby to fix the image to the object; a carrying device for carrying the object along a main carrying route, thereby to feed the object through the image forming device, the transfer device, and the fixing device; a reverse carrying device for carrying the object with the image fixed to the one surface, along a reverse carrying route, thereby to reverse and feed the object again to the transfer device, so as to transfer an image to another surface of the object; a control device for temporarily stopping and keeping the object being carried along the main or reverse carrying route, if necessary; and a detection device for detecting whether the object is positioned at the fixing device, when carrying of the object is temporarily stopped by the control device, wherein if the detection device detects the object positioned at the fixing device, the control device controls operation of the carrying device so as to carry the object until the detection device does not detect the object any more, and then to stop carrying the object.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Figure 1:
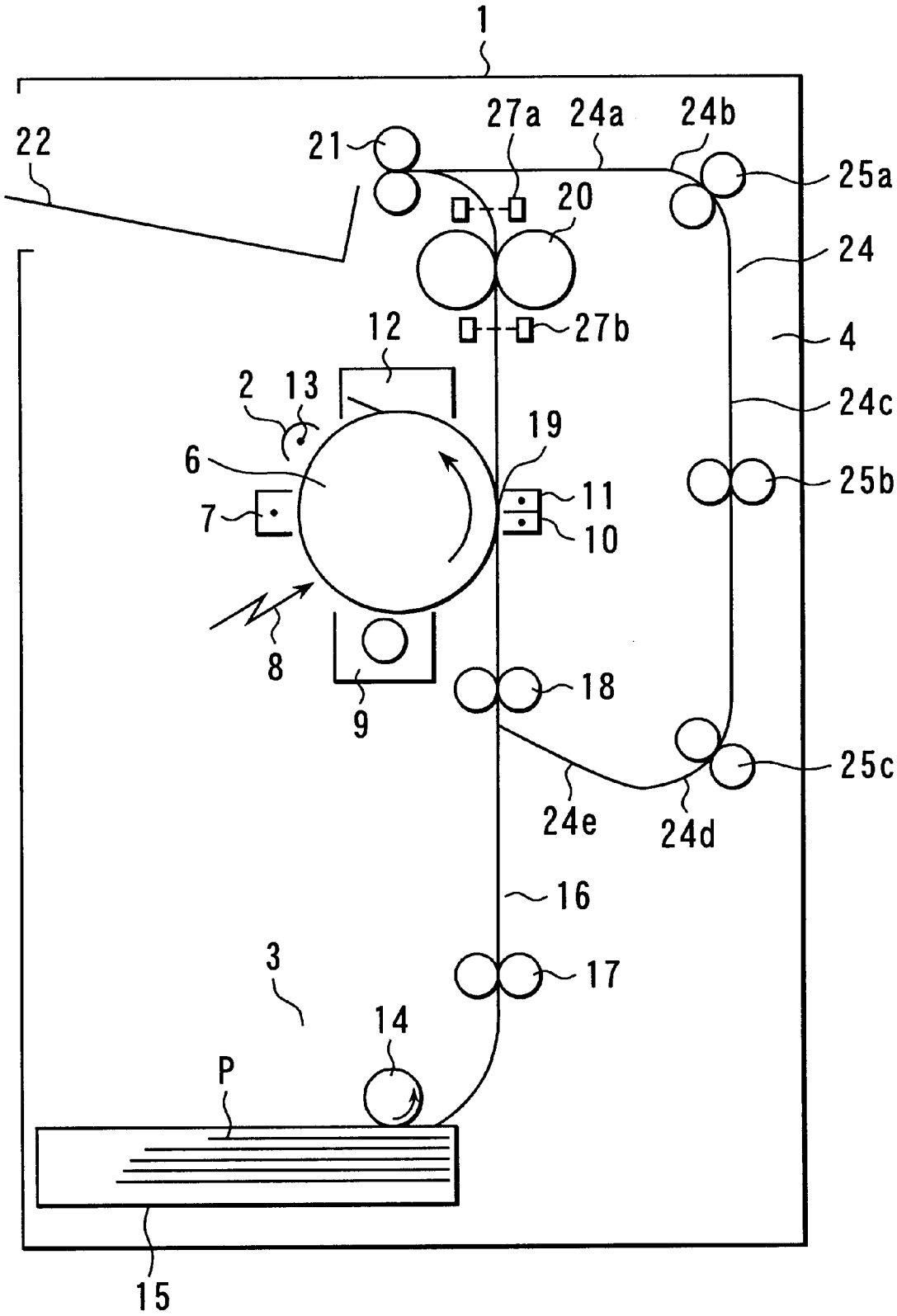
FIG. 1 is a schematic structural view showing an electrophotographic copying machine according to an embodiment of the present invention.

In the following, the present invention will be explained with reference to an embodiment shown in the drawings.

FIG. 1 is a structural view showing an electrophotographic machine as an image forming apparatus according to an embodiment of the present invention.

The electrophotographic machine comprises an apparatus body 1. An image forming section 2 for forming an image on a paper sheet as an object to be carried (e.g., a transfer-target material) in an electrostatic photographic method, a sheet feeder 3 for carrying and supplying a paper sheet for the image forming section 2, and a reverse carrying apparatus 4 for turning over the paper sheet and for returning the paper sheet to the sheet feeder 3. Since the reverse carrying apparatus 4 does not comprise an intermediate tray, the apparatus serves as a so-called non-stack ADU.

The image forming section 2 comprises a rotatable photosensitive drum 6 as an image carrier. Provided in the peripheral part of the photosensitive drum 6 along its rotating direction are members for executing a so-called electrostatic photographic process by means of a process CPU (not shown).

More specifically, the photosensitive drum 6 is constructed by an application type OPC charged in the minus polarity, and this photosensitive drum 6 includes a conductive base member and a photosensitive layer covering the surface of the conductive base member. The photosensitive layer has a film thickness of 15 to 30 $\mu$m and a dielectric constant of 2.0 to 5.0. The conductive base member of the photosensitive drum 6 is grounded.

Provided in the peripheral part of the photosensitive drum 6 along its rotating direction are a charger 7, a scanning optical system (not shown) for emitting imaging light 8, a developing device 9, a transfer device 10, a separator 11, a cleaning device 12, and a discharger 13.

The sheet feeder 3 includes a sheet feed cassette 15 and a main carrying route 16 for carrying a paper sheet supplied from the sheet feed cassette 15 upwards. Paper sheets P as objects which should be carried or to which an image should transferred are contained in the sheet feed cassette 15, and are fed one after another by rotation of the sheet feed roller 14.

The main carrying route 16 is provided along the vertical direction. Paired carrying rollers 17, paired resist rollers 18, an image transfer section 19, paired fixing rollers 20 as a heating device, and paired discharge rollers 21 are provided respectively from the side of the lower part to the side of the upper part on the main carrying route 16. A sheet discharge tray 22 is provided on the side of the paired discharge rollers 21 in which paper sheets are discharged.

The reverse carrying device 4 has a reverse carrying route 24 which connects the sheet discharge side of the paired fixing rollers 20 with the sheet introducing side of the paired resist rollers 18. The reverse carrying route 24 is constructed by a horizontal part 24*a* in the upper side, a corner part 24*b*, a vertical part 24*c*, a corner part 24*d* in the lower side, and a slanting part 24*e*. The corner part 24*b* in the upper side, the vertical part 24*c*, and the corner part 24*d* in the lower side are respectively provided with pairs of carrying rollers 25*a*, 25*b*, and 25*c*.

Meanwhile, upper and lower detection sensors 27*a* and 27*b* for detecting a paper sheet P positioned at the paired fixing rollers 20 are provided respectively in the upstream and downstream sides of the paired fixing rollers 20 provided on the main carrying route 16.

Figure 10:
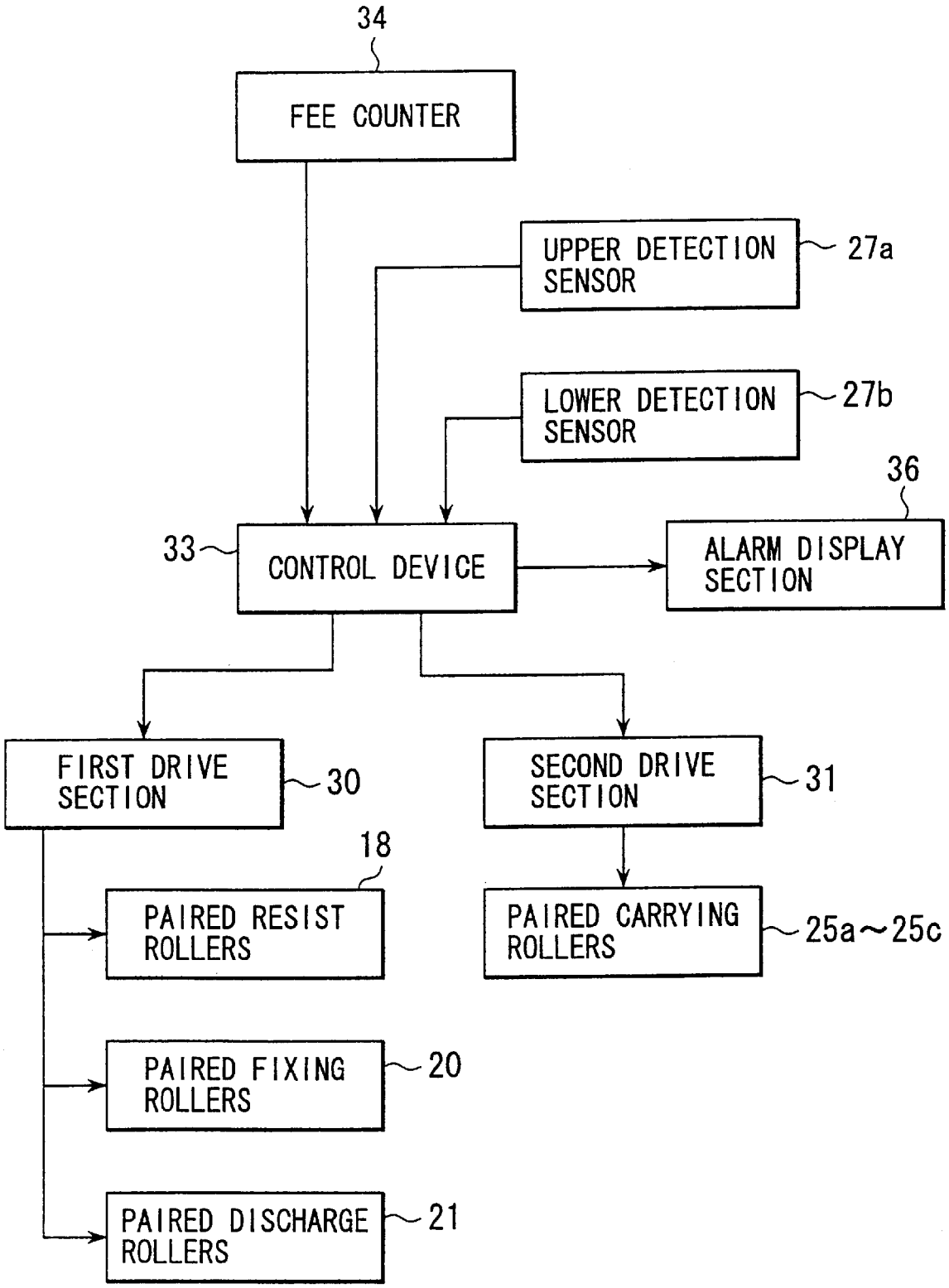
FIG. 10 is a block diagram showing the drive control system of the sheet carrying mechanism.

FIG. 10 is a block diagram showing the drive control system for the paired resist rollers 18, the paired fixing rollers 20, and the sheet discharge rollers 21, which are provided on the main carrying route 16, and the paired carrying rollers 25*a* to 25*c*, which are provided on the reverse carrying route 24.

That is, the paired resist rollers 18, the paired fixing rollers 20, and the sheet discharge rollers 21 are rotated in regular and reverse directions by a first drive section 30. The paired carrying rollers 25*a* to 25*c* are rotated and operated by a second drive section 31.

The first and second drive sections 30 and 31 are connected with a control device 33 through a control circuit. The control device 33 is connected with a fee counter 34 described later through a transmission circuit, and with the upper and lower detection sensors 27*a* and 27*b* through a signal circuit. Further, the control device 33 is connected with a warning display section 36 for displaying a warning indication that paper sheets cannot be escaped, as will be described later.

Next, explanation will be made of a double-side image forming operation with reference to FIGS. 1 to 9.

When forming images on both sides, the surface of the photosensitive drum 6 is charged by the charger 7 at first, and imaging light 8 is irradiated on the surface of the charged photosensitive drum 6, so that an electrostatic latent image corresponding to an original document image is formed on the surface of the charged photosensitive drum 6. This electrostatic latent image is sent to the developing device 9 by rotation of the photosensitive drum 6 and is supplied with magnetic toner as a developing agent from the developing device 9, to form a magnetic toner image.

Figure 2:
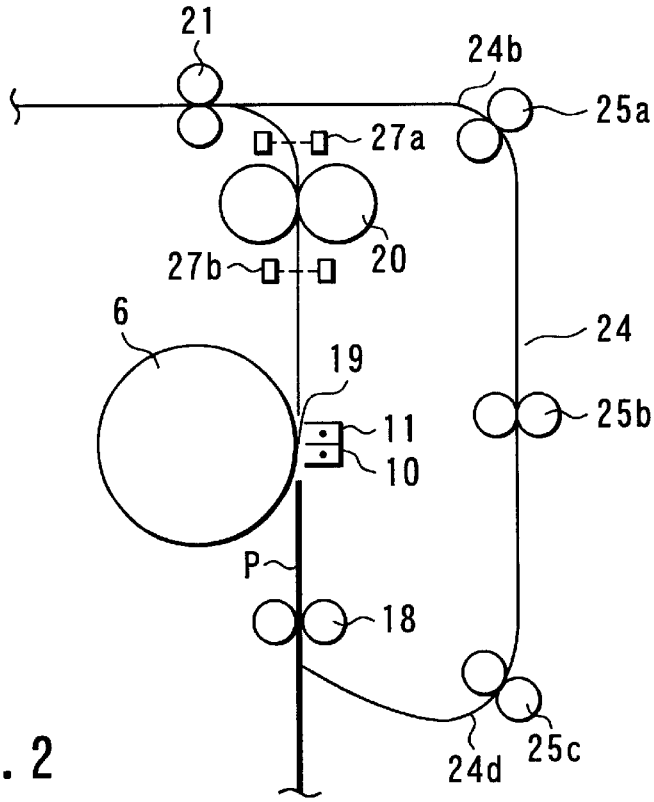
FIG. 2 is a view showing a state in which a paper sheet is being fed to an image transfer section.
Figure 3:
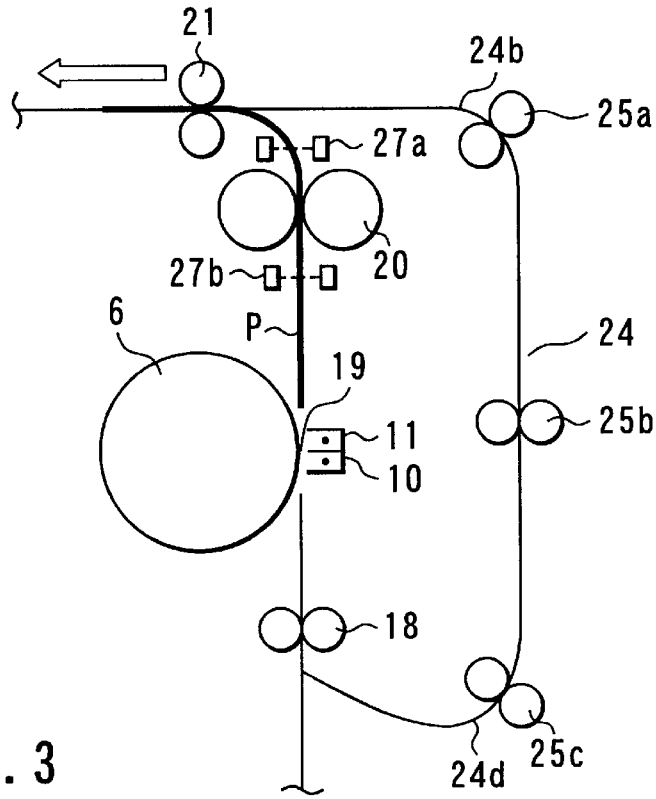
FIG. 3 is a view showing a state in which a paper sheet is being fed out from the image transfer section with an image transferred thereto.

At this time, a paper sheet P is supplied by rotation of the sheet feed roller 14 and is clamped and carried by the paired carrying rollers 17. This paper sheet P is aligned by the paired resist rollers 18 and is thereafter supplied to the image transfer section 19 between the photosensitive drum 6 and the transfer device 10, as shown in FIG. 2. Here, the magnetic toner image on the photosensitive drum 6 is transferred to the paper sheet P. The paper sheet P to which the magnetic toner image has been transferred is separated from the photosensitive drum 6 and carried by the operation of the separator 11. As shown in FIG. 3, this paper sheet is then supplied to the paired fixing rollers 20 where the transferred toner image is fixed to the paper sheet P and is fed out toward the discharge tray 22.

Figure 4:
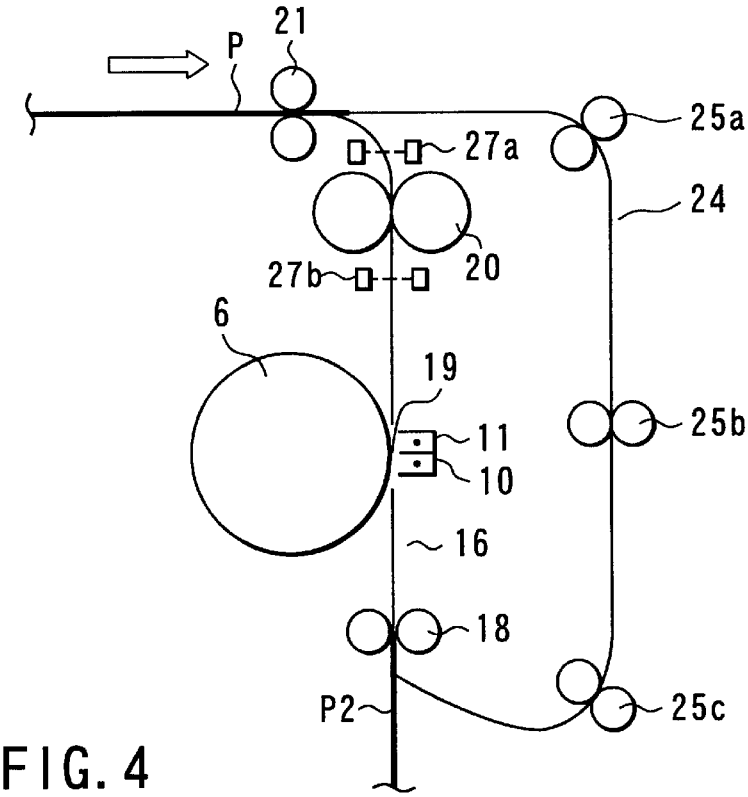
FIG. 4 is a view showing a state in which the paper sheet fed out from the image transfer section is being fed in the reverse direction, and a following paper sheet is being fed into the image transfer section.
Figure 5:
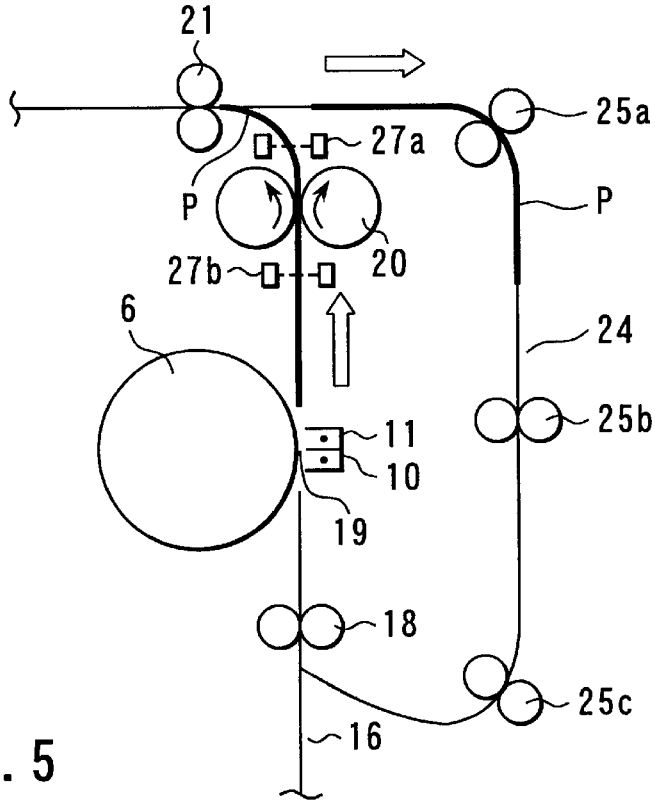
FIG. 5 is a view showing a state in which the paper sheet fed in the reverse direction is being fed into a reverse carrying route, and a following paper sheet is being fed out from the image transfer section with an image transferred thereto.
Figure 6:
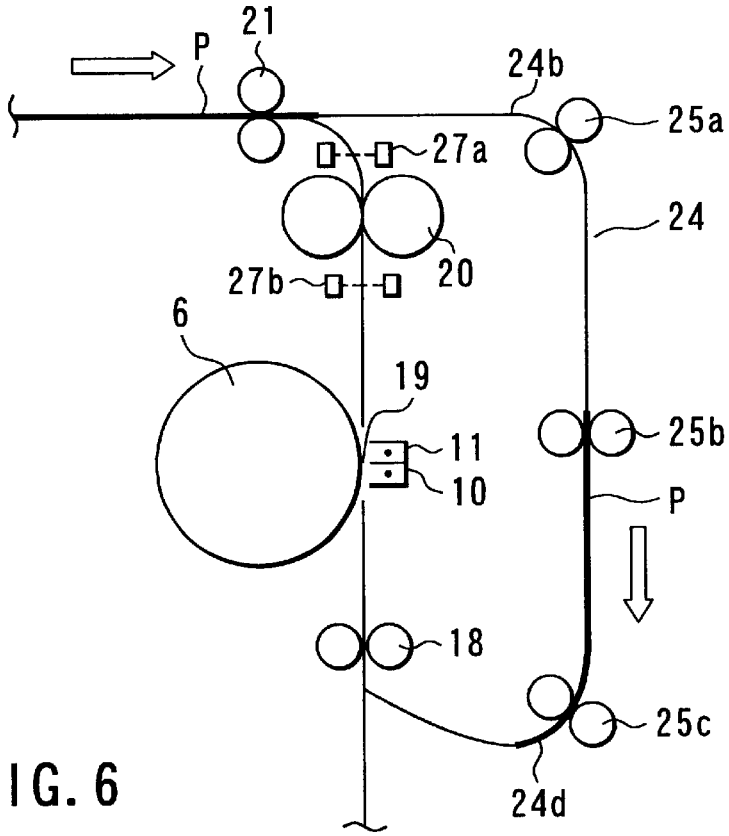
FIG. 6 is a view showing a state in which the paper sheet fed into the reverse carrying route is being carried, and the following paper sheet is being fed in the reverse direction.
Figure 7:
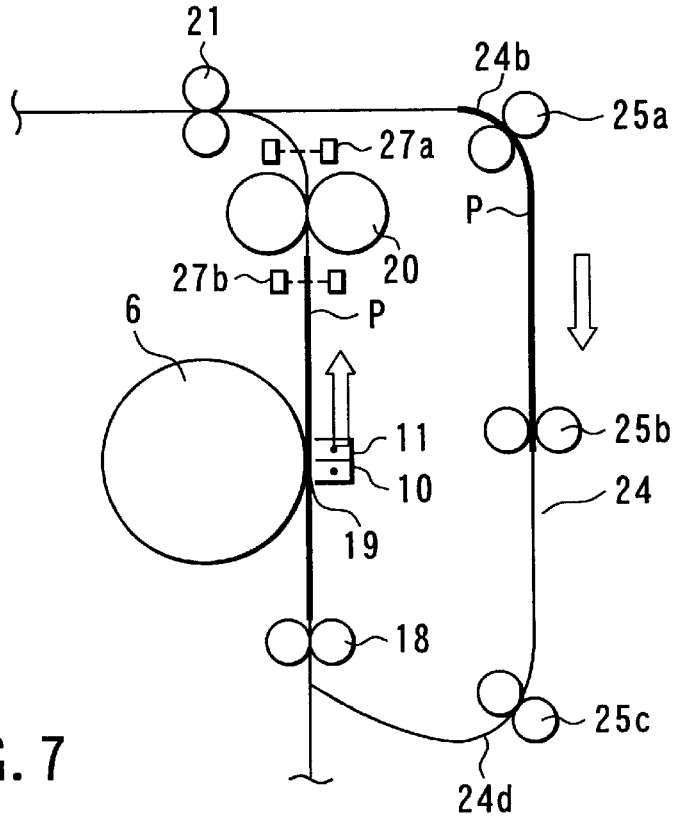
FIG. 7 is a view showing a state in which an image is being transferred to the back surface of the paper sheet fed out from the reverse carrying route, and the following paper sheet is being fed into the reverse carrying route and carried.

After the paper sheet P is fed by a predetermined amount, the paper sheet P is fed in the reverse direction, as shown in FIG. 4, and a following paper sheet P is carried along the carrying route 16. Subsequently, as shown in FIG. 5, the preceding paper sheet P is carried out along the reverse carrying route 24, and a toner image on the photosensitive drum 6 is transferred to the following paper sheet P which is then fed out. After the following paper sheet P is fed by a predetermined amount, it is also fed in the reverse direction as shown in FIG. 6 while the preceding paper sheet P is also carried continuously along the reverse carrying route 24. Thereafter, the preceding paper sheet P is fed into the image transfer section 19, reversed as shown in FIG. 7, and a toner image is transferred to the back surface thereof. The following paper sheet P is carried along the reverse carrying route 24.

Figure 8:
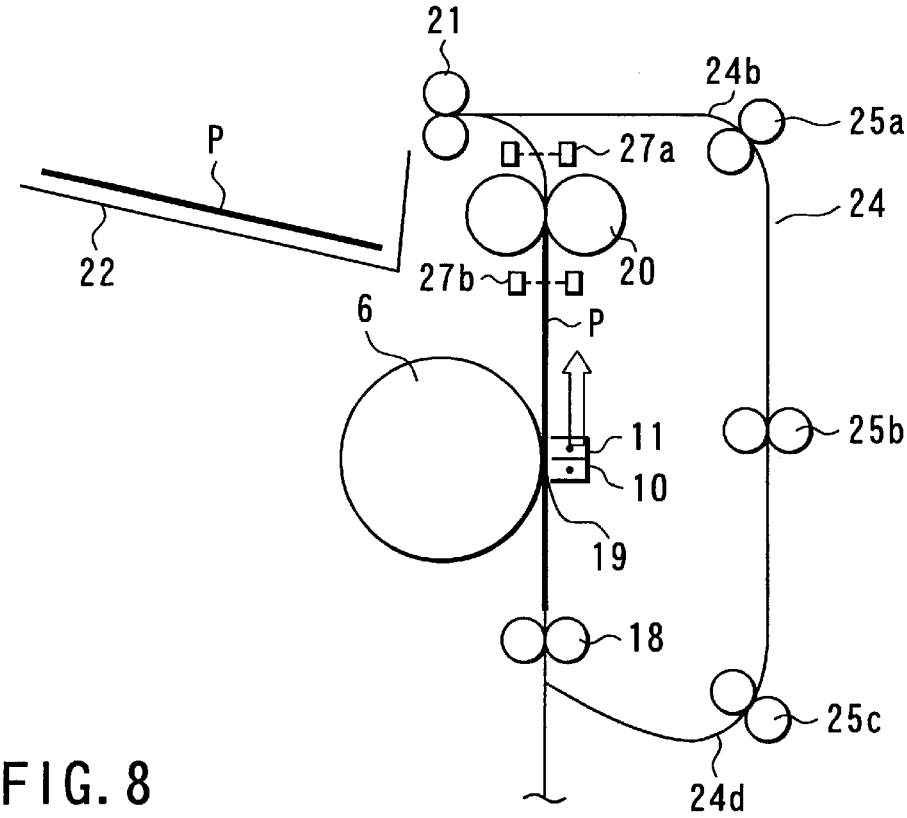
FIG. 8 is a view showing a state in which the paper sheet with an image formed on its back surface is being discharged onto a sheet discharge tray, and an image is being transferred to the back surface of the following paper sheet and carried.
Figure 9:
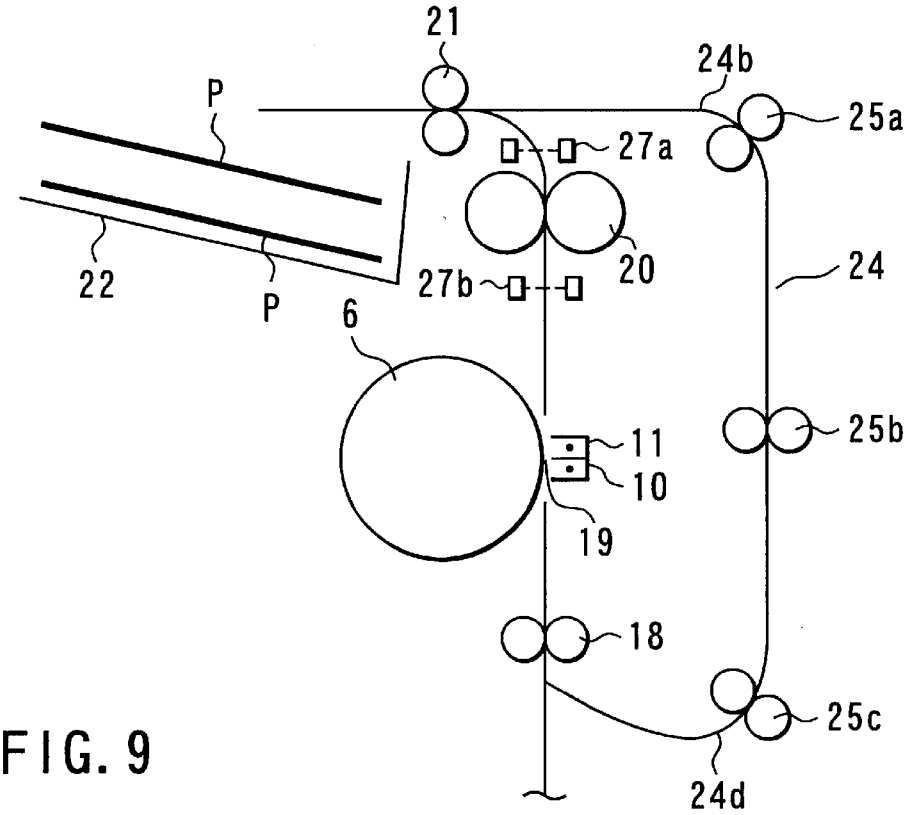
FIG. 9 is a view showing a state in which the following paper sheet with an image formed on its back surface is discharged onto the sheet discharge tray.

The preceding paper sheet P with a toner image transferred to its back surface is discharged onto the discharge tray 22, as shown in FIG. 8. At this time, the following paper sheet P reversed is fed to the image transfer section 19, and a toner image is transferred to its back surface. Thereafter, the following paper sheet P is fed as shown in FIG. 9, and is carried out onto the discharge tray 22.

Meanwhile, there is a case of using the above-described stack-less ADU attached with an accounting device such as a coin controller 34. For example, if data of four pages should be printed on both surfaces of two paper sheets by an electrophotographic copying machine attached with the accounting device, there is a case that the inserted money runs short at the time point when printing of the first, second, and fourth pages is finished. In this case, the paper sheets must be directly discharged without printing the third page to be printed, or must be kept on the reverse carrying route 24.

However, it would be unkind to the user to discharge the paper sheets P without printing the third page.

Otherwise, if the paper sheet P is kept on the reverse carrying route 24, for example, the paper sheet P may be positioned at the paired fixing rollers 20.

If a paper sheet P is positioned at the paired fixing rollers 20, the paper sheet P may be burnt, smoke, or catch fire, causing danger.

In the case where a paper sheet P is positioned at the paired fixing rollers 20, it will be safe if the heat source (not shown) of the paired fixing rollers 20 is turned off. However, it is not desirable to turn off the heat source to temporarily stop carrying the paper sheet during a printing operation, because the paired fixing rollers 20 must be heated again at the time of restarting the printing operation and the processing efficiency is hence deteriorated.

Hence, to overcome the above-described drawback in the present invention, when the inserted money runs short, a signal thereof is transmitted from the fee counter 34 to the control device 33. In this manner, the control device 33 stops driving of the first and second driving sections 30 and 31 to stop and temporarily keep the paper sheet P on the carrying route. At this time, however, if at least one of the upper and lower detection sensors 27*a* and 27*b* provided near the paired fixing rollers 20 detects a paper sheet P positioned at the paired fixing rollers 20, a detection signal thereof is transmitted to the control device 33. Upon receipt of this transmitted signal, the control device 33 stops driving the first driving section 30, to pause carrying of the paper sheet P.

Accordingly, the paper sheet P is escaped from the paired fixing rollers 20, so that the paper sheet P is safely prevented from smoking or burning.

If a sheet-presence signal is continuously transmitted from the detection sensors 27*a* and 27*b* even after regular rotation of the paired fixing rollers 20 is continued for three seconds when the paper sheet P is escaped, the control device 33 controls the paired fixing rollers 20 to rotate in the reverse direction, by means of the fist drive section 30. If the paper sheet P is escaped from the paired fixing rollers 20 by this reverse rotation of the paired fixing rollers 20, the control device 33 stops carrying the paper sheet P.

Further, if a sheet-presence signal is continuously transmitted from the detection sensors 27*a* and 27*b* even after reverse rotation of the paired fixing rollers 20 is continued for five seconds, the control device 33 turns off the heat source of the paired fixing rollers 20 or the power source, and controls the warning display section 36 to display a warning indication expressing that the paper sheet should be removed from the paired fixing rollers 20.

In place of rotating the paired fixing rollers 20 for five seconds, reverse rotation of the paired fixing rollers 20 may be stopped at the time point when the detection sensors 27*a* and 27*b* detect absence of a paper sheet.

If any one of the upper and lower detection sensors 27*a* and 27*b* detects a paper sheet, the paired fixing rollers 20 are rotated and driven so as to move the paper sheet toward the detection sensor 27*a* (or 27*b*) which detects the paper sheet, viewed from the paired fixing rollers 20.

Further, if another paper sheet exists at paired carrying rollers other than the paired fixing rollers 20 when the paper sheet is escaped from the paired fixing rollers 20, it is necessary to control the rotation of the other paired carrying rollers in compliance with the rotation timing and rotating direction of the paired carrying rollers 20 so that the paper sheet which is let escape from the paired fixing rollers 20 might not collide with the paper existing at the other paired carrying rollers.

As described above, if detection sensors 27*a* and 27*b* are provided near the paired fixing rollers 20 and a paper sheet is detected by these detection sensors 27*a* and 27*b,* rotation of the paired fixing rollers 20 is continued. After the detection sensors 27*a* and 27*b* do not detect a paper sheet any more, carrying of the paper sheet is stopped. Therefore, paper sheets are not burnt or do not smoke or catch fire but can be kept safely.

In addition, in the case where paper sheets cannot be escaped from the paired fixing rollers 20, more safety can be attained because the heat source or power source can be turned off or a warning indication expressing that a paper sheet should be removed from the paired fixing rollers 20 is displayed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A carrying apparatus comprising:

a carrying device for carrying an object to be carried, along a carrying route;

a heating device for heating the object being carried along the carrying route;

a control device for temporarily stopping and keeping the object being carried along the carrying route; and a detection device for detecting whether the object is positioned at the heating device, when carrying of the object is temporarily stopped by the control device, wherein if the detection device detects the object positioned at the heating device, the control device controls the operation of the carrying device so as to carry the object until the detection device does not detect the object any more, and then to stop carrying of the object.

2. The apparatus according to claim 1, wherein the detection device is provided on at least one of upstream and downstream sides of the heating device in a direction in which the heating device carries the object.

3. The apparatus according to claim 1, wherein the detection device is a detection sensor which optically detects the object.

4. The apparatus according to claim 1, further comprising a warning display section which displays a warning indication if the detection device continues detecting the object even after the carrying device continues carrying of the object based on detection of the object positioned at the heating device by the detection device.

5. A carrying apparatus comprising:

carrying means for carrying an object to be carried, along a carrying route;

heating means for heating the object being carried along the carrying route;

control means for temporarily stopping and keeping the object being carried along the carrying route; and detection means for detecting whether the object is positioned at the heating means, when carrying of the object is temporarily stopped by the control means, wherein if the detection means detects the object positioned at the heating means, the control means controls operation of the carrying means so as to carry the object until the detection means does not detect the object any more, and then to stop carrying of the object.

6. An image forming apparatus comprising:

an image forming device for forming an image on an image carrier;

a transfer device for transferring the image formed by the image forming device, to one surface of an object to which an image should be transferred;

a fixing device for heating the image transferred by the transfer device, thereby to fix the image to the object;

a carrying device for carrying the object along a main carrying route, thereby to feed the object through the image forming device, the transfer device, and the fixing device;

a reverse carrying device for carrying the object with the image fixed to the one surface, along a reverse carrying route, thereby to reverse and feed the object again to the transfer device, so as to transfer an image to another surface of the object;

a control device for temporarily stopping and keeping the object being carried along the main or reverse carrying route; and a detection device for detecting whether the object is positioned at the fixing device, when carrying of the object is temporarily stopped by the control device, wherein if the detection device detects the object positioned at the fixing device, the control device controls operation of the carrying device so as to carry the object until the detection device does not detect the object any more, and then to stop carrying of the object.

7. The apparatus according to claim 6, wherein the detection device is provided on at least one of upstream and downstream sides of the fixing device in a direction in which the heating device carries the object.

8. The apparatus according to claim 6, wherein the detection device is a detection sensor which optically detects the object.

9. The apparatus according to claim 6, further comprising a warning display section which displays a warning indication if the detection device continues detecting the object even after the carrying device continues carrying of the object based on detection of the object positioned at the fixing device by the detection device.

10. An image forming apparatus comprising:

image forming means for forming an image on an image carrier;

transfer means for transferring the image formed by the image forming means, to one surface of an object to which an image should be transferred;

fixing means for heating the image transferred by the transfer means, thereby to fix the image to the object;

carrying means for carrying the object along a main carrying route, thereby to feed the object through the image forming means, the transfer means, and the fixing means;

reverse carrying means for carrying the object with the image fixed to the one surface, along a reverse carrying route, thereby to reverse and feed the object again to the transfer means, so as to transfer an image to another surface of the object;

control means for temporarily stopping and keeping the object being carried along the main or reverse carrying route; and detection means for detecting whether the object is positioned at the fixing means, when carrying of the object is temporarily stopped by the control means, wherein if the detection means detects the object positioned at the fixing means, the control means controls operation of the carrying means so as to carry the object until the detection means does not detect the object any more, and then to stop carrying of the object.

11. The apparatus according to claim 1, wherein the control device temporarily stops and keeps the object being carried along the carrying route based on an indication from an accounting device.

12. The apparatus according to claim 6, wherein the control device temporarily stops and keeps the object being carried along the carrying route based on an indication from an accounting device connected to the image forming apparatus.

* * * * *